US007272966B2

(12) United States Patent
Gorski et al.

(10) Patent No.: US 7,272,966 B2
(45) Date of Patent: Sep. 25, 2007

(54) MULTIPLE LEVEL ENTRY GUIDE FOR A ROLL FORMING MACHINE

(75) Inventors: Michael Gorski, Sayreville, NJ (US); Terrance J. Johnson, Londonderry, NH (US)

(73) Assignee: Englert, Inc., Perth Amboy, NJ (US)

( * ) Notice: Subject to any disclaimer, the term of this patent is extended or adjusted under 35 U.S.C. 154(b) by 100 days.

(21) Appl. No.: 11/263,698

(22) Filed: Nov. 1, 2005

(65) Prior Publication Data

US 2007/0095120 A1 May 3, 2007

(51) Int. Cl.
*B21B 39/16* (2006.01)

(52) U.S. Cl. ..... 72/176; 72/250; 226/196.1; 83/449; 100/173

(58) Field of Classification Search ..... 72/176, 72/181, 250, 428, 226, 227; 100/173; 226/196.1; 83/449, 450

See application file for complete search history.

(56) References Cited

U.S. PATENT DOCUMENTS

| | | | | | |
|---|---|---|---|---|---|
| 1,691,703 | A * | 11/1928 | Clarke | 72/40 |
| 2,365,322 | A * | 12/1944 | Ashworth | 226/179 |
| 2,775,151 | A * | 12/1956 | Schumacher | 72/226 |
| 3,461,707 | A * | 8/1969 | Maltby | 72/250 |
| 5,220,819 | A * | 6/1993 | Scheib et al. | 72/251 |
| 5,732,582 | A * | 3/1998 | Knudson | 72/131 |
| 5,857,395 | A * | 1/1999 | Bohm et al. | 83/408 |
| 2002/0108421 | A1 * | 8/2002 | Cunningham | 72/176 |

* cited by examiner

*Primary Examiner*—Daniel C Crane
(74) *Attorney, Agent, or Firm*—David L. Davis

(57) ABSTRACT

An entry guide for a roll forming machine having fixed stop members for the different widths of sheet metal material which can be accommodated by the roll forming machine. The fixed stop members are offset in the vertical direction. Accordingly, when the roll forming machine is adapted to accommodate a different width of sheet metal material, there is no need to adjust the entry guide.

5 Claims, 5 Drawing Sheets

MULTIPLE LEVEL ENTRY GUIDE FOR A ROLL FORMING MACHINE

BACKGROUND OF THE INVENTION

This invention relates to roll forming machines and, more particularly, to roll forming machines of the type which can accept sheet metal supply coils of differing widths.

Roll forming machines for producing indeterminate length (i.e., seamless) metal panels, such as rain gutters, roof panels, siding panels, etc., are generally well known. In such a machine, the panels are formed from a supply coil of sheet metal of uniform width having a pair of parallel side edges. As the sheet metal is driven through the machine along a predetermined path of travel through a series of roll forming stations, its lateral profile is gradually transformed from a flat sheet into a panel having a desired lateral profile.

At the entry end of the roll forming machine, the leading edge of the supply coil of sheet metal passes through an entry guide which accurately positions the material laterally of its line of travel so that it is properly aligned for the following series of roll forming stations. Typically, the entry guide includes a pair of laterally spaced stop members which flank the material as it enters the machine. It is not uncommon that the same roll forming machine is used to form more than one size of product, in which case the roll forming machine must accommodate differing widths of sheet metal. When this is the case, the roll forming stations have to be changed and/or moved to accommodate the different sizes. Of course, at the entry guide the stop members have to be moved as well. In the past, the stop members have been collars or blocks slidable on a shaft between limit stops. When the stop members have to be moved, set screws on the collars or blocks are loosened, the collars or blocks are moved to the appropriate limit stops, and the set screws are tightened. Invariably, over time the set screws become stripped, are lost, etc., which causes a big problem. It would therefore be desirable to have an entry guide for a roll forming machine which can accommodate differing widths of sheet metal and which does not suffer from the aforementioned disadvantages.

SUMMARY OF THE INVENTION

According to this invention, the entry guide has fixed stop members for the different widths of sheet metal material. The fixed stop members are offset in the vertical direction. In the case where the roll forming machine can accommodate two different widths of sheet metal material, the upper stops can be for wider width sheet metal material than the lower stops. Thus, if the wider width sheet metal material is being formed, it is fed into the roll forming machine at the level of the upper stops and if the narrower width sheet metal material is being formed it is fed into the roll forming machine at the level of the lower stops.

BRIEF DESCRIPTION OF THE DRAWINGS

The foregoing will be more readily apparent upon reading the following description in conjunction with the drawings in which like elements in different figures are identified by the same reference numeral and wherein.

DETAILED DESCRIPTION

Figure 1:
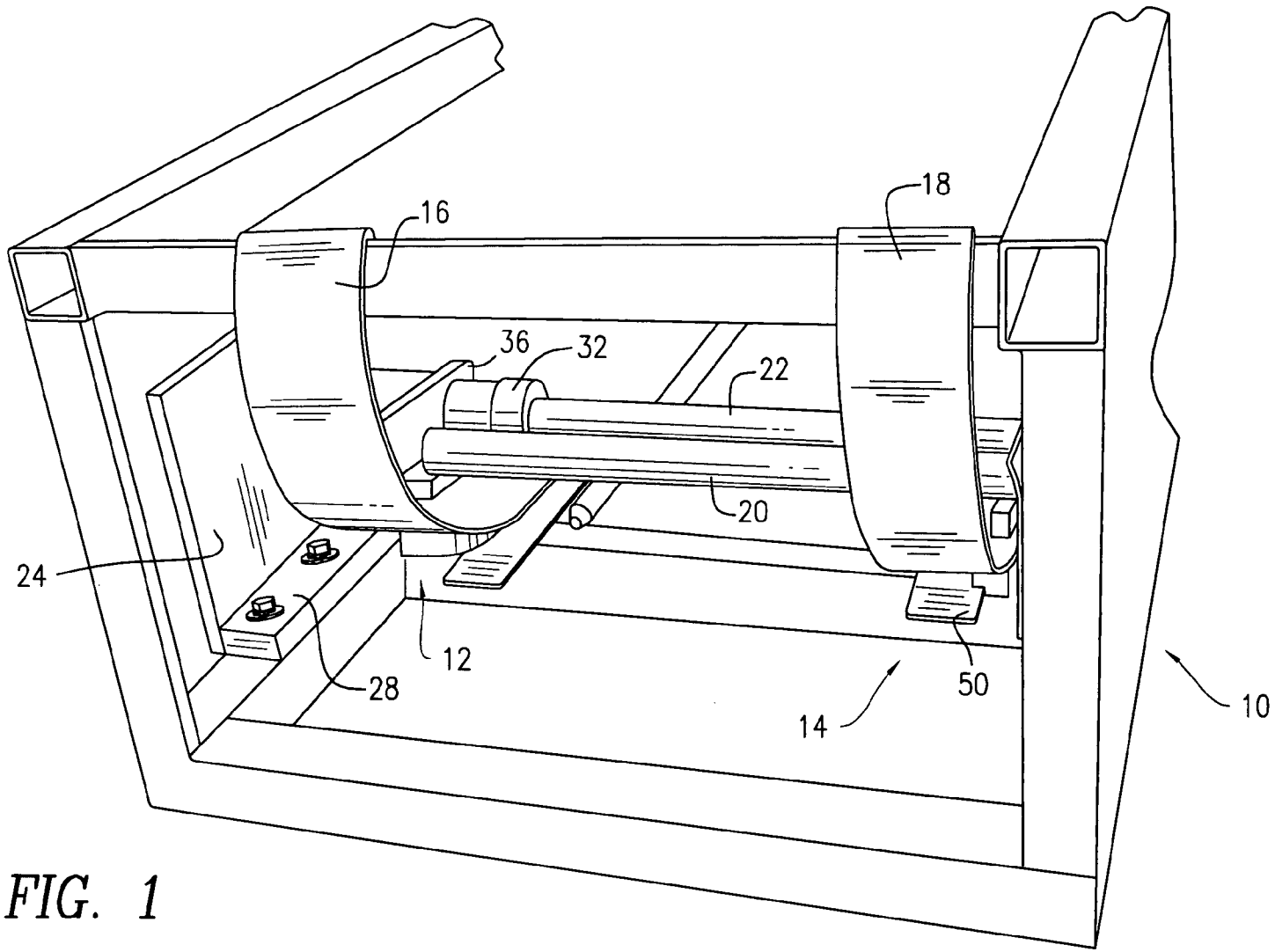
FIG. 1 is a perspective view showing the entry end of a roll forming machine including an embodiment of the inventive entry guide.
Figure 2:
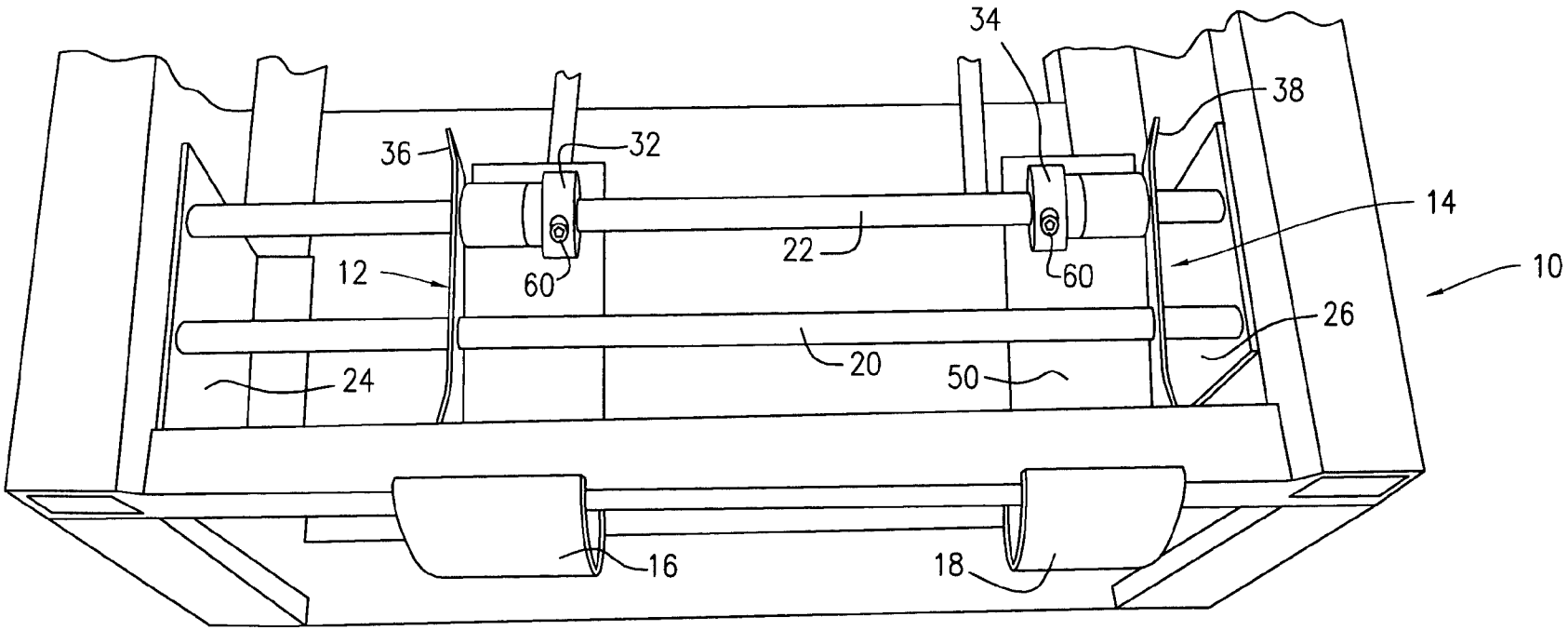
FIG. 2 is a top perspective view of the entry end of the roll forming machine shown in FIG. 1.
Figure 3:
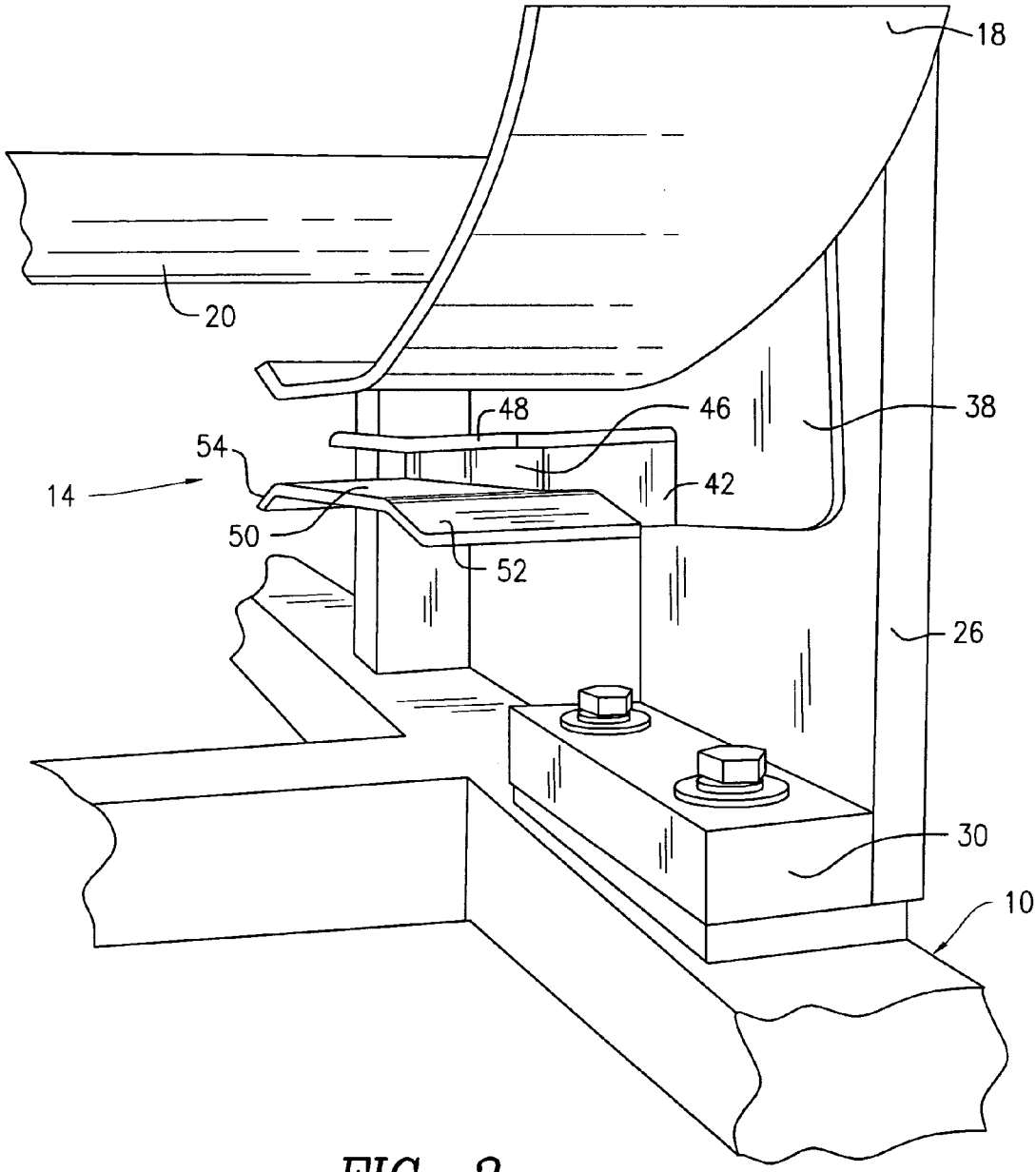
FIG. 3 is an enlarged perspective view showing details of a first side of the entry guide shown in FIG. 1, with the second side of the entry guide being substantially a mirror image thereof.

Referring to the drawings, FIGS. 1, 2 and 3 show the entry end of a roll forming machine, designated generally by the reference numeral 10, which includes an entry guide constructed according to the present invention. The inventive entry guide is capable of accepting two different widths of sheet metal material in order to form two different size panels, and includes a pair of spaced apart stop assemblies 12 and 14, which are substantially mirror images of each other. Each of the stop assemblies 12,14 is associated with a respective curved guide member 16,18. The guide members 16,18 function to provide a smooth transition surface for the sheet metal material entering the roll forming machine 10, as is common in the roll forming art.

Figure 5:
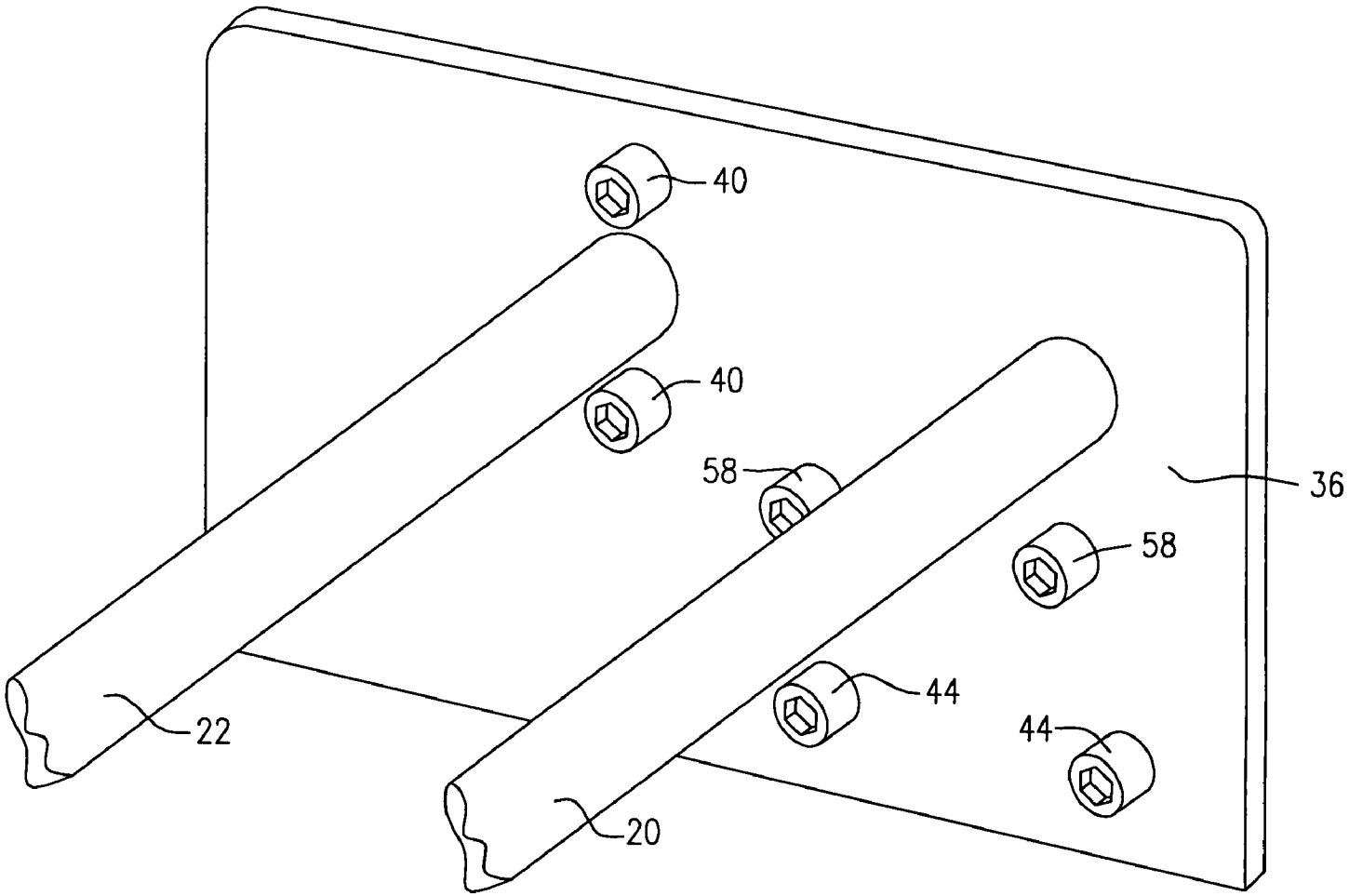
FIG. 5 is an enlarged perspective view showing how the second side of the inventive entry guide is held together, with the first side being substantially a mirror image thereof.

The inventive entry guide includes the parallel shafts 20 and 22, which are secured to the frame of the machine 10 by being bolted to the vertical plates 24 and 26, which in turn are welded to the horizontal plates 28 and 30 which are bolted to the frame of the machine 10. The shaft 22 has slidably mounted thereon a pair of split collars 32 and 34. The collars 32,34 are secured to the vertical plates 36 and 38, respectively, by the bolts 40, as shown in FIG. 5. The plate 36 is part of the stop assembly 12 and the plate 38 is part of the stop assembly 14.

Figure 4:
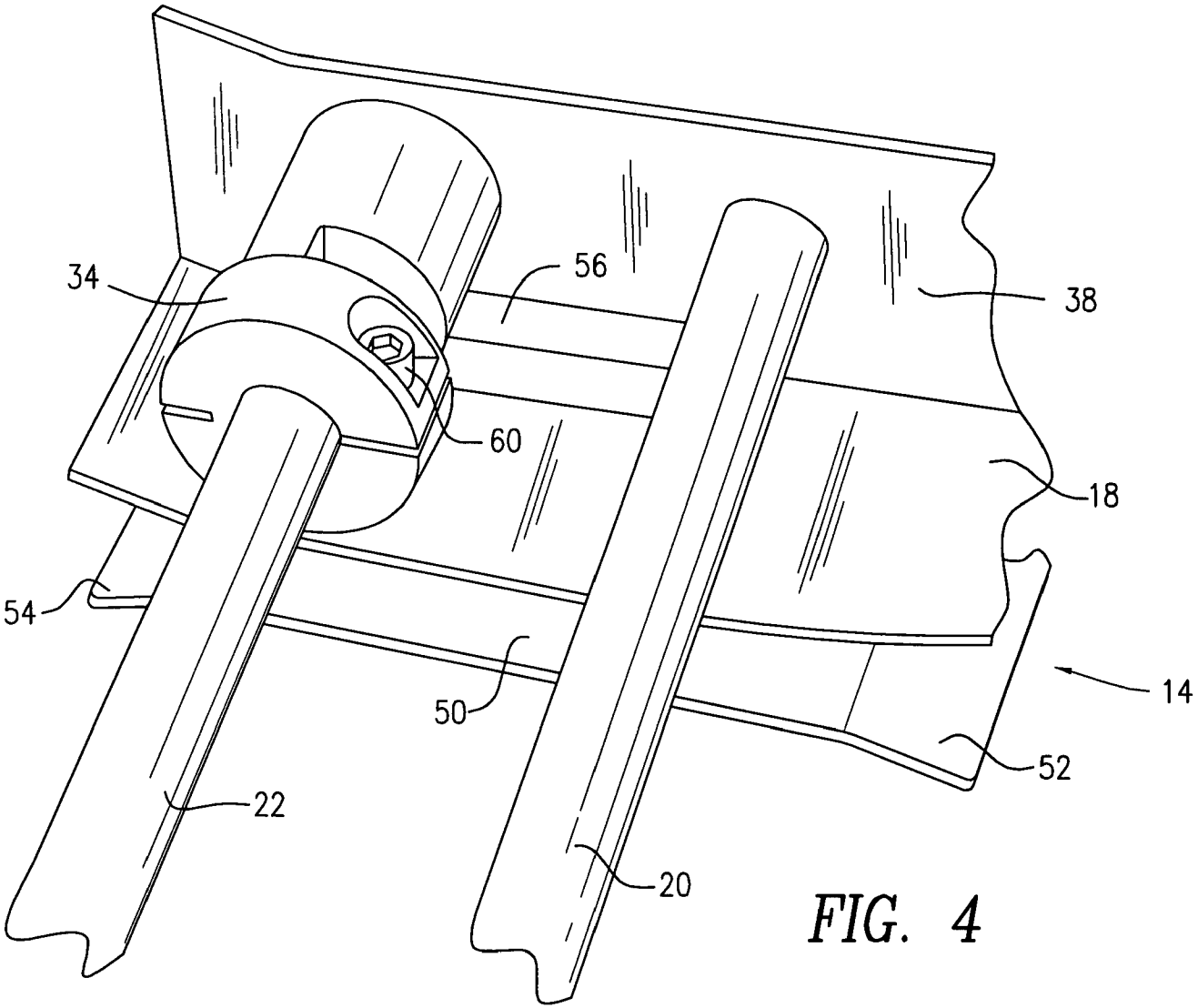
FIG. 4 is am enlarged perspective view showing the lateral adjustment mechanism for the first side of the inventive entry guide, with the second side being substantially a mirror image thereof.

The stop assembly 14 will be described with reference to FIGS. 3-5, it being understood that the stop assembly 12 functionally is a mirror image of the stop assembly 14. In the illustrative embodiment, everything is referenced from the right side of the roll forming machine 10, as viewed in FIG. 1. As shown in FIG. 5, the block 42 is secured to the plate 38 by the bolts 44. The block 42 is substantially rectilinear so that its surface 46 is spaced from and parallel to the plate 38. The block 42 is a spacer block, sized to account for a difference in profile between the two panel sizes. The corresponding block of the stop assembly 12 accounts for the remainder of the difference between the two sheet metal material widths.

A first substantially horizontal plate 48 is secured to an upper surface of the block 42 and a second substantially horizontal plate 50 is secured to a lower surface of the block 42, both by welding or other suitable means. If desired, the plate 50 may have angled portions 52,54 at its leading and trailing ends, respectively. Thus, if the wider sheet metal material is used, it is loaded into the machine 10 by guiding it onto the plate 48 with its edge against the vertical plate 38, and if the narrower width sheet metal material is used, it is loaded into the machine 10 by guiding it onto the plate 50 with its edge against the vertical surface 46 of the block 42. Accordingly, the vertical surface 46 of the block 42 and the vertical plate 38 function as entry guide stops for respective widths of sheet metal material.

The guide member 18 is secured to the stop assembly 14 by being welded to the block 56, which is secured to the vertical plate 38 by the bolts 58.

To properly set the stop assemblies 12,14, The collars 32,34 are loosened by loosening the bolts 60. The stop assembly 14 is then moved along the shafts 20,22 until it is properly aligned with the roll forming stations on that side of the machine 10. The bolt 60 on the collar 34 is then tightened to secure the stop assembly 14. The stop assembly 12 is then moved along the shafts 20,22 until it is distanced from the stop assembly 14 with the vertical plates 36,38 separated by the width of the wider sheet metal material. This automatically sets the entry guide for the narrower sheet metal material as well. The bolt 60 on the collar 32 is then tightened to secure the stop assembly 12.

Accordingly, there has been disclosed a multiple level entry guide for a roll forming machine. While an illustrative embodiment of the present invention has been disclosed herein, it will be appreciated that various adaptations and modifications to the disclosed embodiment are possible without departing from the spirit and scope of the invention. Thus, while there has been disclosed an entry guide for accepting two different widths of sheet metal material, the present invention can be adapted to three or more widths. It is therefore intended that this invention be limited only by the scope of the appended claims.

What is claimed is:

1. An entry guide for a roll forming machine, comprising:

a first pair of horizontal platforms secured to the machine at a first horizontal level;

a second pair of horizontal platforms secured to the machine at a second horizontal level vertically displaced from the first horizontal level;

a first pair of stop members each associated with a respective one of said first pair of horizontal platforms, wherein each of said first pair of stop members has a vertical surface extending upwardly and orthogonally from the respective one of said first pair of horizontal platforms and wherein the vertical surfaces of said first pair of stop members face each other, are parallel to each other and are spaced apart a first predetermined distance; and a second pair of stop members each associated with a respective one of said second pair of horizontal platforms, wherein each of said second pair of stop members has a vertical surface extending upwardly and orthogonally from the respective one of said second pair of horizontal platforms and wherein the vertical surfaces of said second pair of stop members face each other, are parallel to each other and are spaced apart a second predetermined distance different from said first predetermined distance.

2. The entry guide according to claim 1 wherein said first predetermined distance is greater than said second predetermined distance and said first pair of horizontal platforms is above said second pair of horizontal platforms.

3. An entry guide for a roll forming machine, comprising a pair of spaced apart stop assemblies, wherein each of said stop assemblies includes:

a planar vertical plate;

a block secured to said vertical plate on the side of said vertical plate facing the other of said pair of stop assemblies, said block having a vertical surface parallel to and spaced from said vertical plate;

a first horizontal plate secured to an upper surface of said block; and a second horizontal plate secured to a lower surface of said block;

wherein the vertical plates of the pair of stop assemblies are parallel to each other;

whereby, within each of said stop assemblies, said vertical plate and said vertical surface of said block each functions as a stop member for a respective width of sheet metal material introduced into said roll forming machine.

4. The entry guide according to claim 3 further comprising a pair of parallel horizontal shafts secured to said roll forming machine; and wherein said pair of stop assemblies are slidable toward and away from each other on said pair of shafts.

5. The entry guide according to claim 4 wherein:

each of said stop assemblies includes a respective split collar secured to the vertical plate of the respective stop assembly;

said split collar is slidable on a first of said shafts; and said split collar is selectively tightenable to secure the respective stop assembly at a desired position on said pair of shafts.

* * * * *